US005253714A

United States Patent [19]

Davis et al.

[11] Patent Number: 5,253,714

[45] Date of Patent: Oct. 19, 1993

[54] WELL SERVICE TOOL

[75] Inventors: John P. Davis, Cypress, Tex.; Robert S. Beeman, Bossier City, La.

[73] Assignee: Baker Hughes Incorporated, Houston, Tex.

[21] Appl. No.: 931,246

[22] Filed: Aug. 17, 1992

[51] Int. Cl.[5] ..... E21B 10/00

[52] U.S. Cl. ..... 166/376; 166/55

[58] Field of Search ..... 166/376, 377, 381, 382, 166/383, 387, 54.5, 54.6, 55, 55.1-55.7

[56] References Cited

U.S. PATENT DOCUMENTS 5,036,921 8/1991 Pittard et al. ..... 166/376 X 5,090,480 2/1992 Pittard et al. ..... 166/376 X

FOREIGN PATENT DOCUMENTS 1282687 9/1991 Canada ..... 166/53

OTHER PUBLICATIONS

"Coiled tubing . . . operations and services," World Oil, Jul. 1992, (U.S.A).

Tri-State Oil Tools Catalog, pp. 4, 7, 10, 32, 33, 1992 (U.S.A.).

*Primary Examiner*—Thuy M. Bui

*Attorney, Agent, or Firm*—Melvin A. Hunn; Mark D. Perdue

[57] ABSTRACT

A well service tool has a mandrel including a fluid flow conduit therethrough in fluid communication with a workstring including a fluid pressure source. An expendable knife-mounting sleeve is coupled to the mandrel and includes at least one cutting knife pivotally secured thereto. A housing is disposed about and secured against rotation relative to the mandrel by drive pins and is selectively movable relative to the mandrel responsive to fluid pressure from the fluid pressure source. The housing includes a positive extender to extend the cutting knives and temporarily maintain them in an extended position. A closure member is coupled to the mandrel to selectively obstruct fluid flow through the fluid conduit, wherein fluid pressure within the fluid conduit is increased, and wherein relative movement between the housing and the mandrel is induced. A probe is coupled to the housing to open the closure member upon a selected extension of the cutting knives wherein fluid pressure within the mandrel is decreased. At least one stabilizer may be coupled between the mandrel and the housing and is extendable from the housing to center the well service tool in the wellbore and to provide reversed relative movement between the housing and the mandrel to retract the knife from the extended position.

19 Claims, 9 Drawing Sheets

WELL SERVICE TOOL

BACKGROUND OF THE INVENTION

1. Field of the Invention

The present invention relates to well service tools. More particularly, the present invention relates to well service tools used for cutting or disintegrating objects in a wellbore such as casing, cement, or other debris lodged in the wellbore.

2. Summary of the Prior Art

Cutting tools for use in an existing wellbore, such as descalers, underreamers, tubing cutters, casing cutters, section mills, and the like, are conventional and well-known in the well service arts. Such tools typically are rotated to selectively cut or mill through objects disposed in a wellbore, and frequently are run into the wellbore through reduced-diameter conduits such as production tubing. Typically, these tools employ knives or cutting arms that are pivotally mounted to a portion of the well service tool. The knives may be selectively expanded radially outwardly from the tool to engage the object to be cut, milled, or reamed. The ends of the knives, which contact the object, typically are dressed with an abrasive material such as that disclosed in U.S. Pat. No. 4,978,260, issued on Dec. 18, 1990, to Lynde et al.

Canadian Patent No. 1,282,687, issued on Apr. 9, 1991, to Hailey discloses a prior-art well service tool. This patent discloses a pair of knives pivotally mounted to the body of the tool by means of a pin. The knives are arranged on the pin in a scissor fashion wherein an hydraulic piston acts on the uppermost surfaces of the knives to expand them radially outwardly from the tool body, into engagement with the object to be cut.

Such a typical prior-art well service tool has number of disadvantages. Because the knives are maintained in an extended position by a hydraulically actuated piston, the force necessary to retract the knives is a function of the fluid pressure exerted on the piston. If the force on the extended knives by cutting action exceeds the force exerted by the piston, the knives tend to retract during cutting operation and cutting engagement is lost, or an undergage hole is bored. Also, the knives are pinned to a major structural component of the well service tool. Because of the torsional forces exerted on the knives, the mounting pins and tool body surrounding the pins become the primary point of wear and failure. If the pins or tool body surrounding the pins fails, a major structural component of the tool is damaged and requires expensive and time-consuming replacement or repair.

Additionally, such direct piston-actuated well service tools may extend the knives in an uneven fashion, wherein one knife is further extended from the tool body than is another knife. Such uneven extension tends to result in an uneven, undergage cut, and may cause vibration and chattering of the well service tool and the workstring on which it is run.

The present invention overcomes these disadvantages by providing a well service tool for cutting, boring, or milling an object in a wellbore that has cutting arms or knives that are pivotally mounted to an expendable and easily replaced component of the well service tool. The present invention also provides a well service tool having a positive mechanism for extending the knives radially outwardly from the well service tool body and positively maintaining the knives in the extended position.

SUMMARY OF THE INVENTION

It is a general objective of the present invention to provide an improved well service tool for cutting, milling, boring or otherwise disintegrating objects in a wellbore.

This and other objectives of the invention are accomplished by providing a well service tool having a mandrel including a fluid flow conduit therethrough in fluid communication with a workstring including a fluid pressure source. An expendable knife-mounting sleeve is coupled to the mandrel and includes at least one cutting knife pivotally secured thereto. A housing is disposed about and secured against rotation relative to the mandrel by drive pins and is selectively movable relative to the mandrel responsive to fluid pressure from the fluid pressure source. The housing includes a positive extender to extend the cutting knives and temporarily maintain them in an extended position. A closure member is coupled to the mandrel to selectively obstruct fluid flow through the fluid conduit, causing fluid pressure within the fluid conduit to increase, causing relative movement between the housing and the mandrel. A probe is coupled to the housing to open the closure member upon a selected extension of the cutting knives causing fluid pressure within the mandrel to decrease. At least one stabilizer may be coupled between the mandrel and the housing and is extendable from the housing to center the well service tool in the wellbore and to provide reversed relative movement between the housing and the mandrel to retract the knife from the extended position.

Other objectives, features, and advantages of the present invention will be apparent from the drawings and detailed description, which follow.

DETAILED DESCRIPTION

Figure 1:
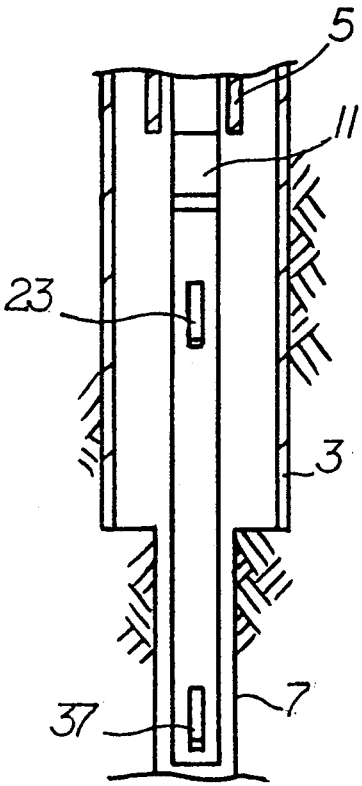
FIG. 1 is an elevation view, partially in section, of a well service tool according to the present invention disposed in a wellbore in an unset mode of operation in which the cutting knives are not extended.

With reference now to the Figures, and particularly with reference to FIG. 1, the well service tool according to the present invention will be described. FIG. 1 depicts a wellbore 3 including reduced-diameter production tubing 5 at an upper end thereof, and a reduced-diameter open wellbore 7 formed therein below production tubing 5. A well service tool 11 according to the present invention is shown disposed in wellbore 3 below production tubing 5 and within reduced-diameter open wellbore 7. Well service tool 11 may be provided with at least one stabilizer 23, in this case three, and is provided at least one knife or cutting arm 37, in this case three. Well service tool 11 is illustrated in an unset mode of operation in which stabilizers 23 and knives or cutting arms 37 are retracted flush with the exterior of well service tool 11. An unset mode of operation is provided to permit greater run-in clearance between well service tool 11 and wellbore 3 so that well service tool may pass through obstructed wellbores 3 or reduced-diameter production tubing 5 more easily.

Figure 2:
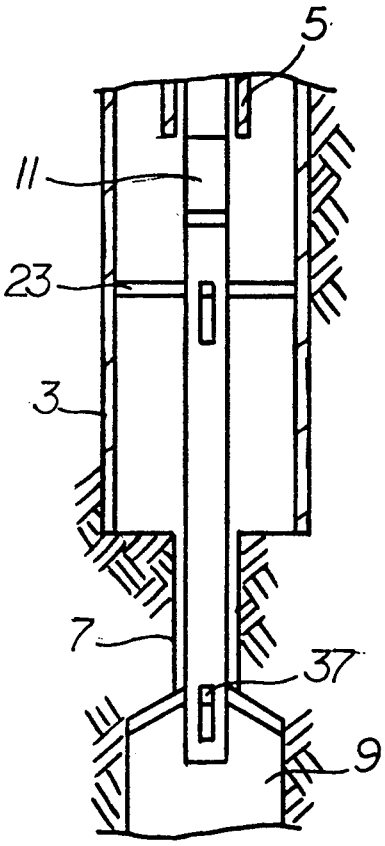
FIG. 2 is an elevation view, partially in section, of a wellbore tool according to the present invention disposed in wellbore in a set mode of operation in which stabilizers and cutting knives are extended radially from the tool.

Referring now to FIG. 2, well service tool 11 is illustrated in a set or cutting mode of operation in which stabilizers 23 and knives or cutting arms 37 are extended radially outwardly from well service tool 11 into cutting position. In this actuated or extended mode of operation, stabilizers 23 are extended into contact with wellbore 3 to centralize well service tool within wellbore 3 to prevent vibration and chattering effects upon rotation of well service tool In highly deviated wellbores, however, stabilizers 23 may be undesirable because, rather than centering well service tool 11, they tend to induce undesirable and unnecessary bending moments on knives 37. Cutting arms or knives 37 are extended to engage reduced-diameter open wellbore 7 so that it may be underreamed into an enlarged-diameter open wellbore 9. Again, cutting arms or knives 37 may engage casing, a fish, production tubing, or the like, rather than reduced-diameter open wellbore 7.

Figure 3A:
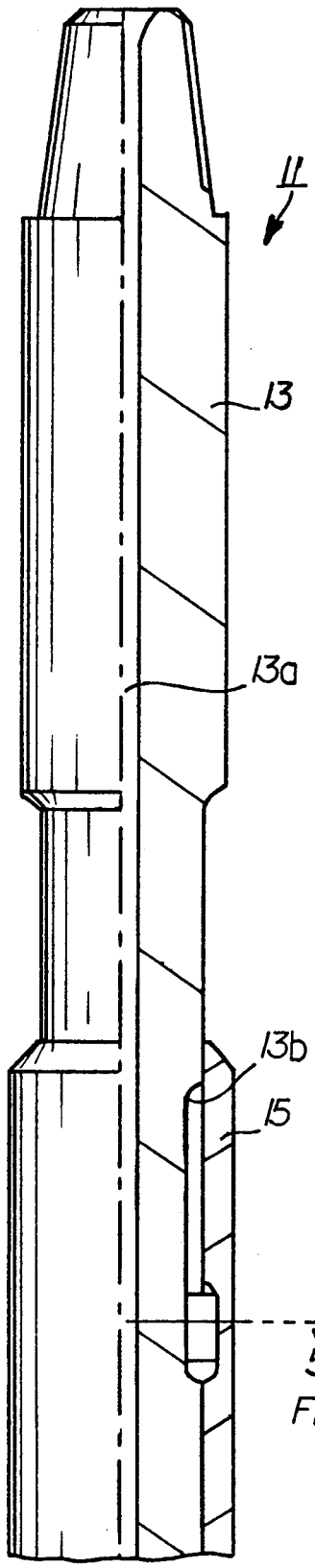
FIGS. 3*a*, 3*b*, and 3*c*, taken together, are partial longitudinal section views of the wellbore tool according to the present invention in the unset mode of operation.
Figure 3B:
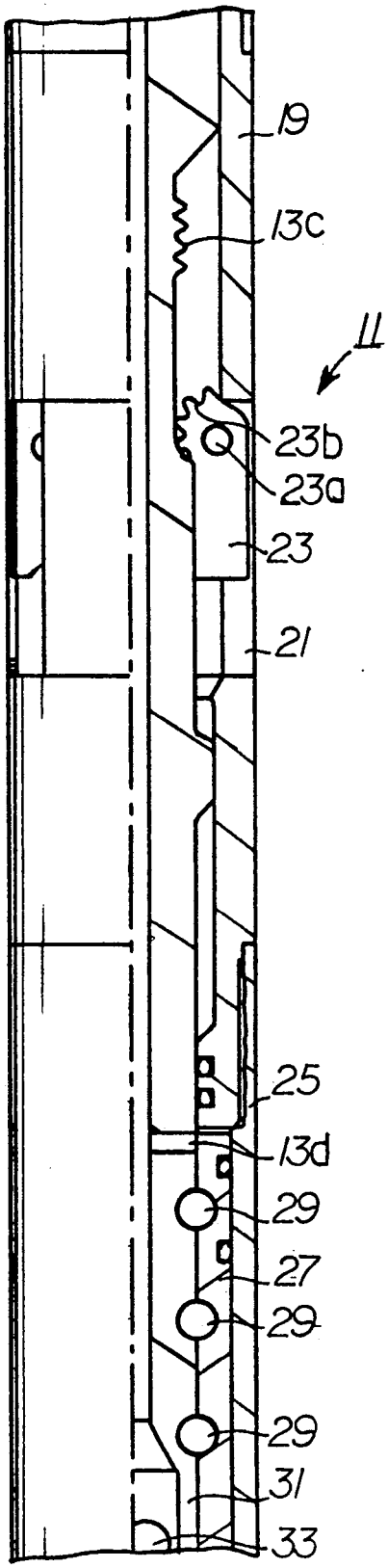
Figure 3C:
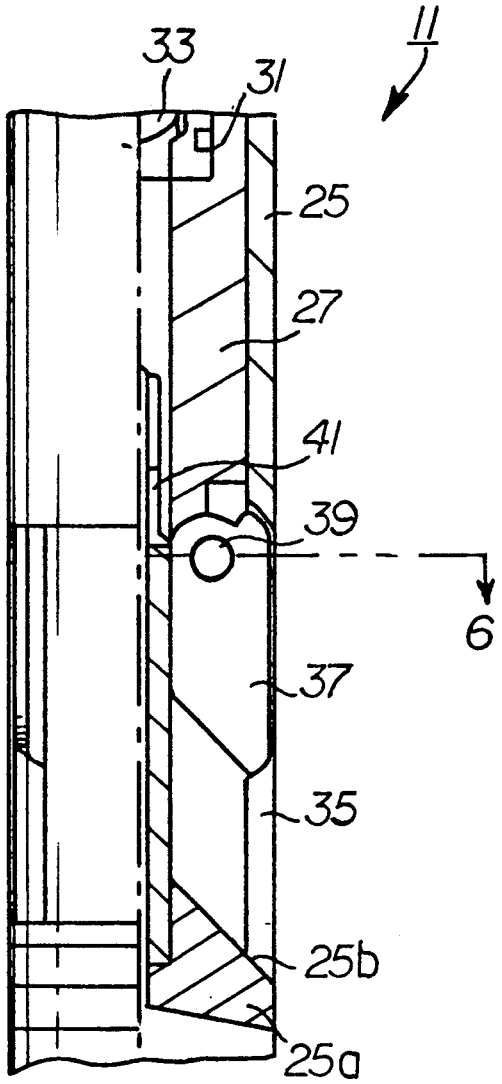

FIGS. 3*a*, 3*b*, and 3*c* should be read together and depict, in partial longitudinal section, a preferred embodiment of well service tool 11 according to the present invention. Well service tool 11 is provided with a mandrel 13, which is threaded at its upper extent for connection into a workstring (not shown). The workstring may be coiled tubing, coiled tubing with a mud motor just above well service tool 11, or a conventional pipe workstring. Mandrel 13 is provided with a fluid conduit 13*a* therethrough, which permits fluid communication between mandrel 13 and a fluid pressure source (not shown) in the workstring (not shown). Mandrel 13 is also provided with a plurality of longitudinal grooves 13*b*, a plurality of segments of rack gear teeth 13*c*, and at least one fluid port 13*d*, the respective functions of which are described hereinafter.

A housing collar 15 is slidably disposed about and encloses a portion of mandrel 13. A plurality of drive pins 17 are circumferentially spaced about mandrel 13 to secure housing collar 15 against rotation relative to mandrel 13. Drive pins 17 serve to transmit torque from the workstring through mandrel 13 to housing collar 15. A plurality of longitudinal grooves 13*b* formed in mandrel 13 receive drive pin 17 and permit housing collar 15 to slide longitudinally with respect to mandrel 13 while transmitting torque from mandrel 13 to housing collar 15. Housing collar 15 is provided to ease assembly and manufacture of well service tool 11.

A housing 19 is coupled by threads to housing collar 15 and likewise surrounds mandrel 13. A stabilizer window 21 is formed through the wall of housing 19 to permit extension of stabilizer 23. Stabilizer 23 is secured to housing 19 by a pin 23*a*. Stabilizer 23 is further provided, at an end adjacent pin 23*a*, with a series of pinion gear teeth 23*b* formed to engage a mating series of rack gear teeth 13*c* on mandrel 13, in response to relative movement between housing 19 and mandrel 13.

A housing body 25 is coupled by threads to housing 19 and likewise surrounds and encloses mandrel 13. Housing body 25 should be considered, along with housing collar 15 and housing 19, part of a pressure-responsive housing member. Housing collar 15, housing 19, and housing body 25 are provided to ease assembly and manufacture of well service tool 11.

An expendable knife-mounting member 27 is disposed radially intermediately mandrel 13 and housing body 25. Expendable knife-mounting member 27 is coupled to mandrel 13 by ball or pin members 29. Ball or pin members 29 are conventional and maintain knife-mounting member 27 stationary relative to mandrel 13, but provide sufficient "play" or "slop" (compared to threaded or welded connections) to ease the assembly and manufacture of well service tool 11. Ball or pin members 29 are fed into mating receptacles formed in mandrel 13 and knife-mounting member 27 through channels in knife-mounting member 27, which are obstructed by welding or by placement of housing body 25 over the channels, thereby retaining ball or pin members 29 in their respective mating receptacles formed in mandrel 13 and piston 27.

A closure member 31, in this case a ball seat, is disposed within expendable knife-mounting member 27 and abuts a lowermost extent of mandrel 13. Closure member 31 is adapted to receive ball 33, which at least partially obstructs fluid flow through fluid flow conduit 13*a* defined through mandrel 13. According to the preferred embodiment of the present invention, closure member 31 is provided with a plurality of circumferentially spaced slots that permit a relatively small amount of fluid flow around ball 33, which is necessary if well service tool 11 is to be used on a coiled tubing string with a mud motor because of the mud motor requirement of fluid circulation through well service tool 11 at all times.

A knife window 35 is provided through the wall of housing body 25 to permit extension of cutting arm or knife 37. Cutting arm or knife 37 is conventional, and typically is dressed at a cutting end thereof with an abrasive material such as conventional hardfacing or the like. Knife 37 is pivotally secured at another end thereof to expendable knife-mounting member 27 by means of a pin 39. A feature of the present invention is that knife 37 is secured to a relatively small and generally expendable part 27 of well service tool 11, rather than to a principal structural member of well service tool 11 such as mandrel 13. With expendable knife-mounting member 27, knives 37 and knife-mounting member 27 may be easily replaced and repaired in a field location proximal to wellbore 3 without complete disassembly of well service tool The only disassembly required is to uncouple housing body 25 from housing 19, and subsequently to uncouple knife-mounting member 27 from mandrel 13. Also, use of expendable knife-mounting member 27 permits knives 37 to be pivotally secured to well service tool 11 nearer the center line of tool 11, which permits the use of larger diameter, stronger pins 39.

A positive extender 25*a* is formed on a lowermost end of housing body 25. Extender 25*a* is formed with an upwardly facing cam surface 25*b*, in this case an inclined surface, adapted to engage a mating, oppositely facing surface on knife 37. Cam surface 25*b* need not be inclined, but could also have a shoulder formed thereon to engage a mating shoulder on knife 37 to provide even more positive extension than inclined surface 25*b*.

A probe 41 is coupled to the lowermost end of housing body 25. Probe 41 is of a selected length to engage and open closure member 31 upon a selected extension of cutting knives 37. Relative movement between the housing assembly (including housing collar 15, housing 19, and housing body 25) and mandrel 13 will cause probe 41 to move upwardly relatively to closure member 31, and engage and open closure member 31 upon a selected extension of knives 37 by positive extender 25*a* of housing body 25.

Figure 4A:
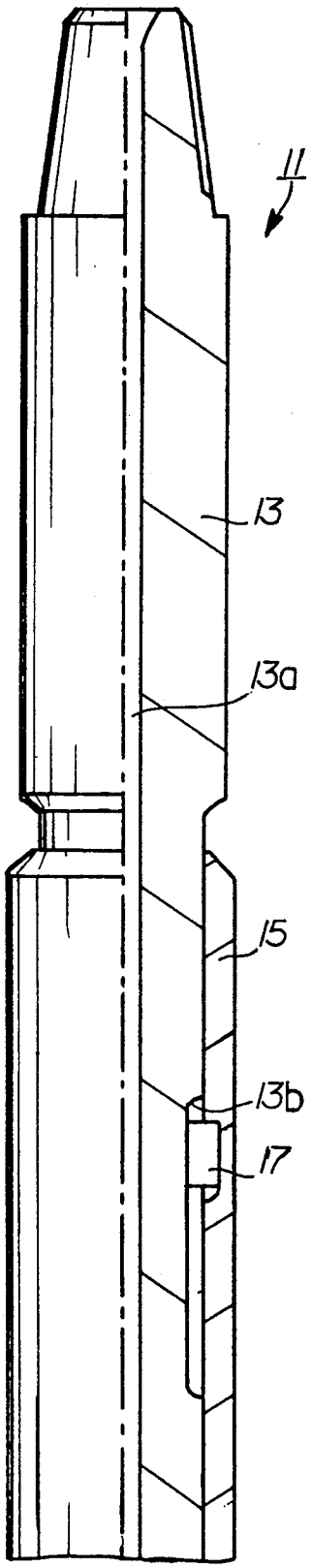
FIGS. 4*a*, 4*b*, and 4*c*, taken together, are partial longitudinal section views of the well service tool according to the present invention in the set mode of operation.
Figure 4B:
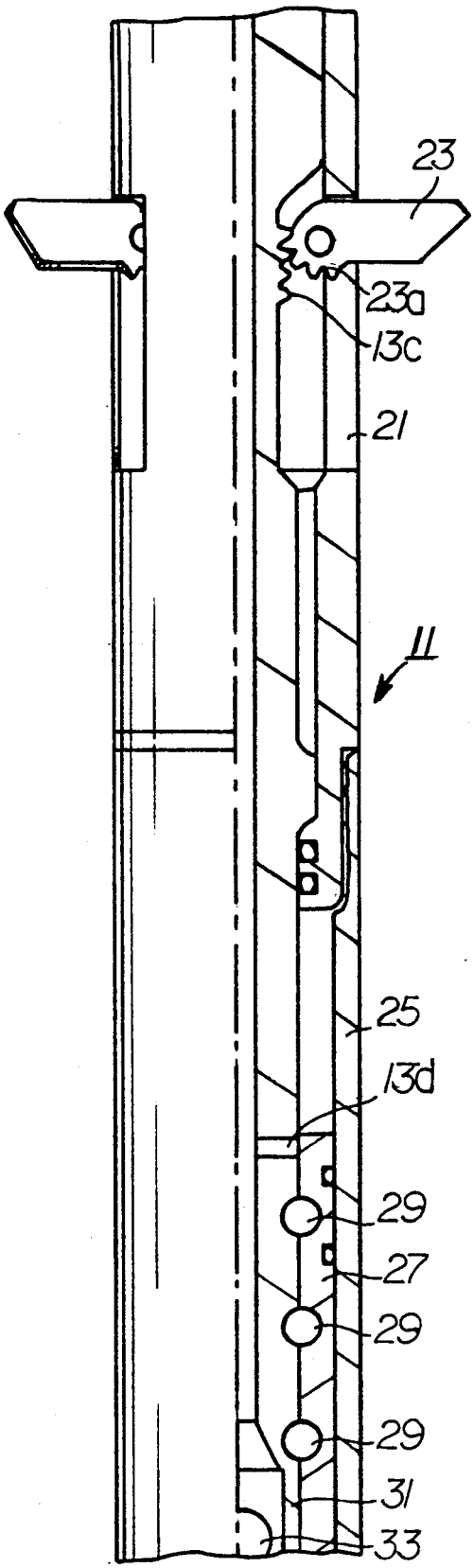
Figure 4C:
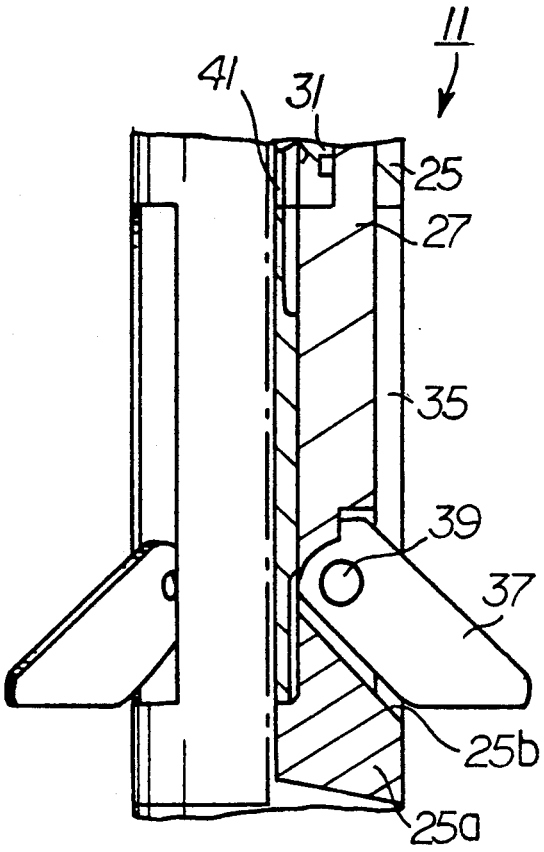

FIGS. 4*a*, 4*b*, and 4*c* should be read together and depict, in partial longitudinal section, well service tool 11 according to the present invention in a set or cutting mode of operation. In the set or cutting mode of operation, the structure of well service tool 11 remains identical to that depicted in FIGS. 3*a* through 3*c*. However, relative movement between housing collar 15, housing 19, and housing body 25, and mandrel 13 has extended stabilizer 23 and knife 37 generally radially outwardly from the exterior of well service tool 11 for stabilizing and cutting engagement, respectively, with the object to be disintegrated (reduced-diameter open wellbore 7 in FIGS. 1 and 2).

Relative movement between the pressure-responsive member (housing collar 15, housing 19, and housing body 25), and mandrel 13 is caused by pressurized fluid from within fluid conduit 13*a* entering a chamber (defined between housing 19, housing body 25, expendable knife-mounting member 27, and mandrel 13) through port 13*d* in mandrel. The pressurized fluid causes housing 19 and expendable knife-mounting member 27 to move apart from each other, wherein relative movement between the pressure responsive member (housing collar 15, housing 19, and housing body 25), and mandrel 13 is induced.

The arrangement of drive pins 17 and grooves 13*b* in mandrel permits relative axial movement between housing collar 15 and mandrel 13, yet maintains the ability of mandrel 13 to transmit torque, through drive pins 17, to housing collar 15. Housing collar 15, in turn, transmits torque to housing 19, which transmits torque to housing body 25.

Stabilizer 23 is extended generally radially outwardly from the exterior of well service tool 11 through stabilizer window 21 by the engagement of pinion gear teeth 23*a* of stabilizer 23 and rack gear teeth 13*c* of mandrel 13. Relative movement between housing 19 and mandrel 13 causes pinion gear teeth 23*a* and rack gear teeth 13*c* to engage and extend stabilizer 23.

Knife 37 is extended generally radially outwardly from the exterior of well service tool 11 through knife window 35 by engagement between upper cam surface 25*b* of positive extender 25*a*, which is integral with housing body 25, and mating lower surface of knife 25. The engagement of the mating cam surface of knife 37 and upper cam surface 25*b* of positive extender 25*a* is caused by relative movement between housing body 25 and mandrel 13. The engagement between upper cam surface 25*b* and knife 37 causes knife 37 to pivot about pin 39, extending an end of knife 37 generally radially outwardly into an extended position. The interposition of positive extender 25*a* under knife 37, and frictional engagement therebetween, positively maintains knife 37 in an extended position by preventing knife 37 from pivoting about pin 39 into the retracted position within housing body 25.

Probe 41 is engaged with ball 33 to displace ball from closure member or ball seat 31. The displacement of ball 33 from closure member or ball seat 31 permits relatively high rates of fluid flow through closure member 31 and to the exterior of well service tool 11. Probe 41 is of a length selected to engage ball 33 after a selected movement of housing body 25 relative to mandrel 13.

Figure 5:
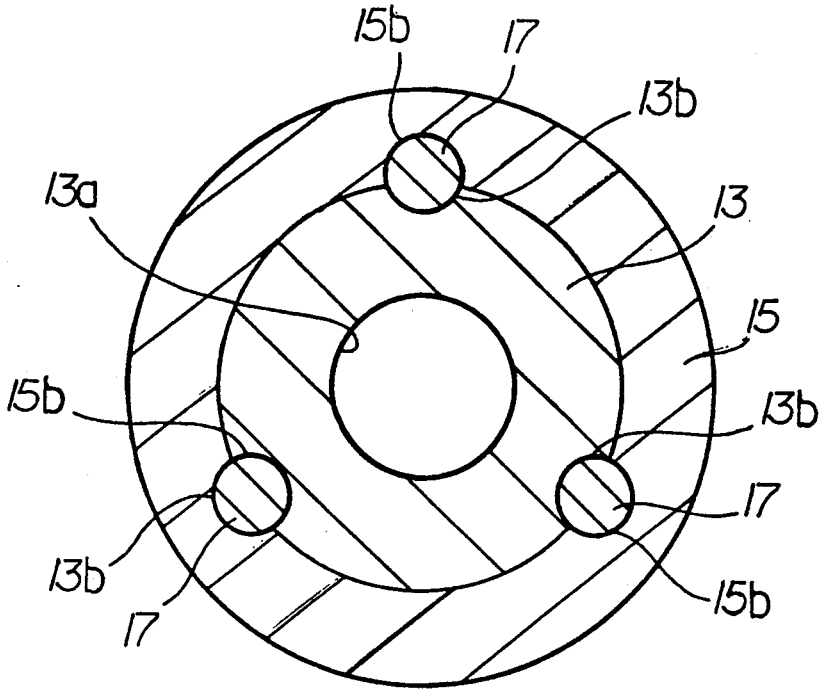
FIG. 5 is a plan view of the cross-section of the well service tool of the present invention, the section taken along line V—V of FIG. 3*b*.

FIG. 5 is a cross-section plan view of well service tool 11 according to a preferred embodiment of the present invention, the section taken along line V—V of FIG. 3*b*. The section illustrates the arrangement of drive pins 17 between mandrel 13 and housing collar 15. As is illustrated, three drive pins fit in mating receptacle halves of grooves 13*b*, 15*b* formed in mandrel 13 and housing collar 15, respectively. As discussed with reference to FIGS. 3*a* through 3*c* and FIGS. 4*a* through 4*c*, drive pins 17 permit the transmission of torque from mandrel 13 to housing collar 15 and allow housing collar 15 to move longitudinally relative to mandrel 13 Such an arrangement permits relative movement between mandrel 13 and housing collar 15, which is necessary for the extension of stabilizers 23 and knives 37.

Figure 6:
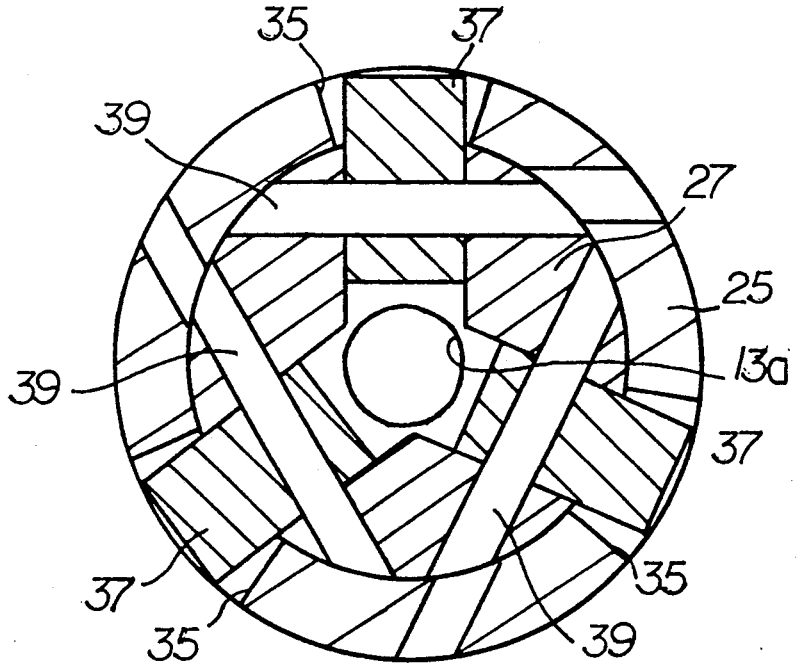
FIG. 6 is a plan view of the cross-section of the well service tool of the present invention, the section taken along line VI—VI of FIG. 3*c*.

FIG. 6 is a cross-section plan view of well service tool 11 according to a preferred embodiment of the present invention, the section taken along line VI—VI of FIG. 3*c*. Knives 37 are pivotally secured to expendable knife-mounting member 27 by pins 39. Pins 39 are loaded into their receptacles through ports in housing body 25. Pins 39 are maintained in their respective receptacles by housing body 25, which is assembled over expendable knife-mounting member 27 after knives 37 and pins 39 are assembled onto expendable knife-mounting member 27. Rotation of housing body 25 during assembly obstructs the receptacle containing pins 39, thereby preventing their loss, and pivotally secures knives 37 to expendable knife-mounting member 27 without the use of snap rings, cap screws, or the like. Knife windows 35, formed in housing body 25, permit the extension of knives 37.

Figure 7A:
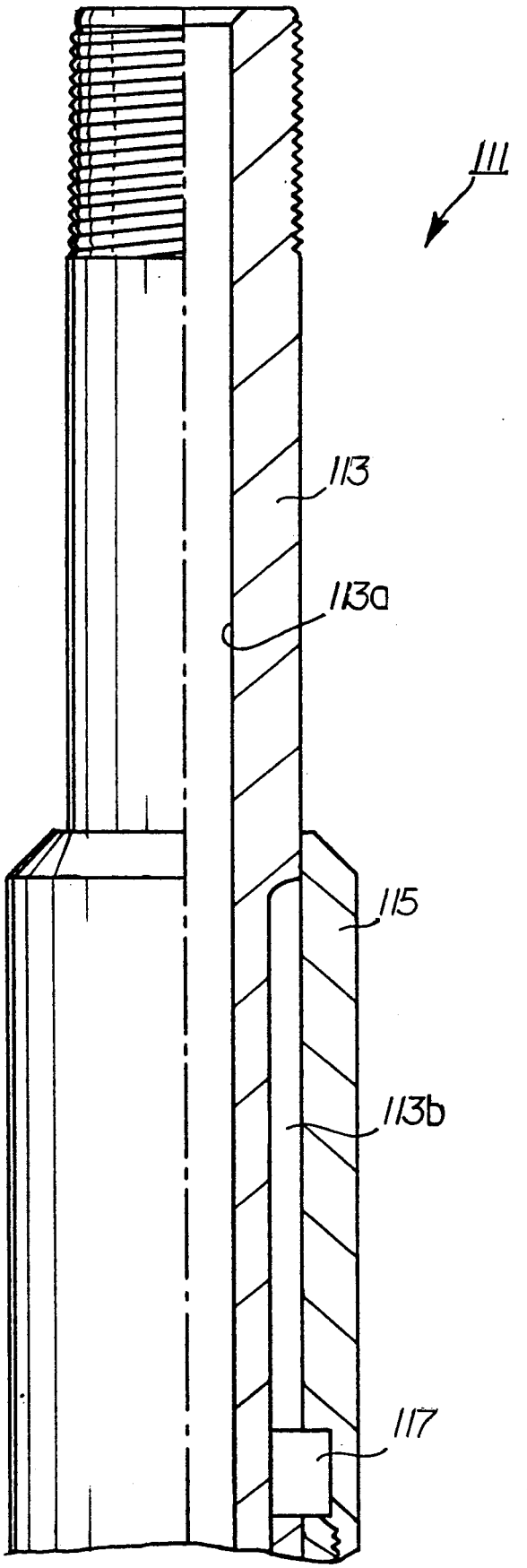
FIGS. 7*a*, 7*b*, and 7*c*, taken together, are one-quarter longitudinal section view of another embodiment of the wellbore tool according to the present invention in the unset mode of operation.
Figure 7B:
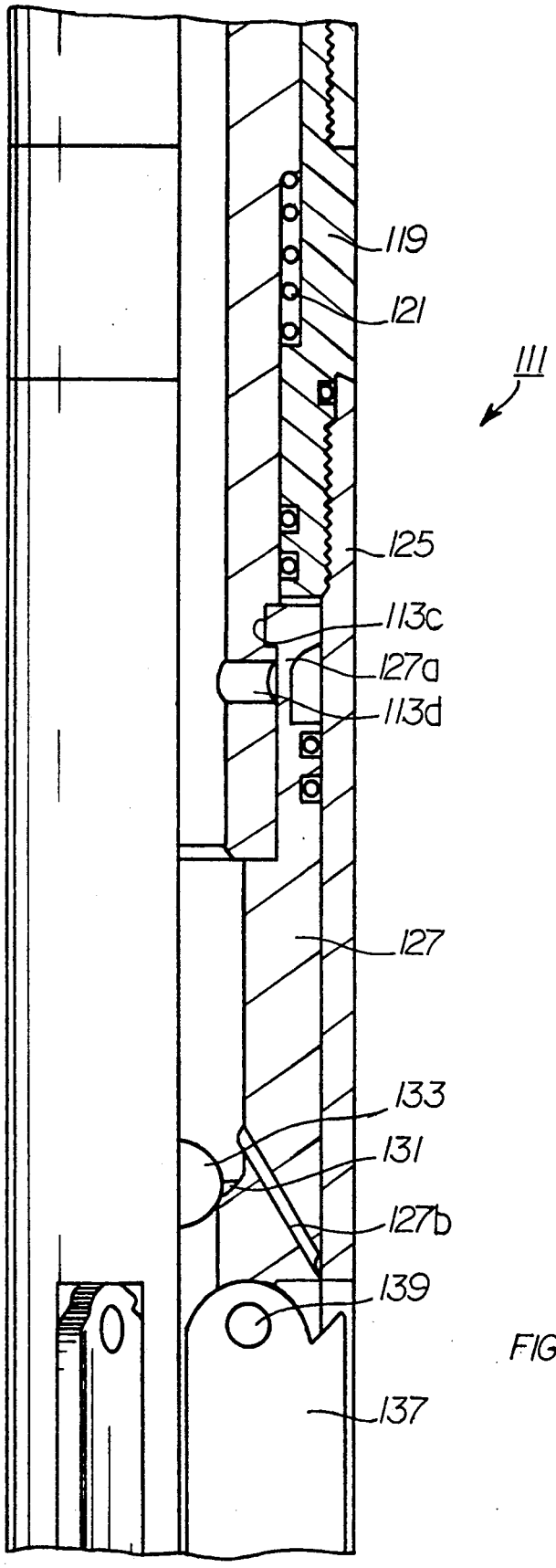
Figure 7C:
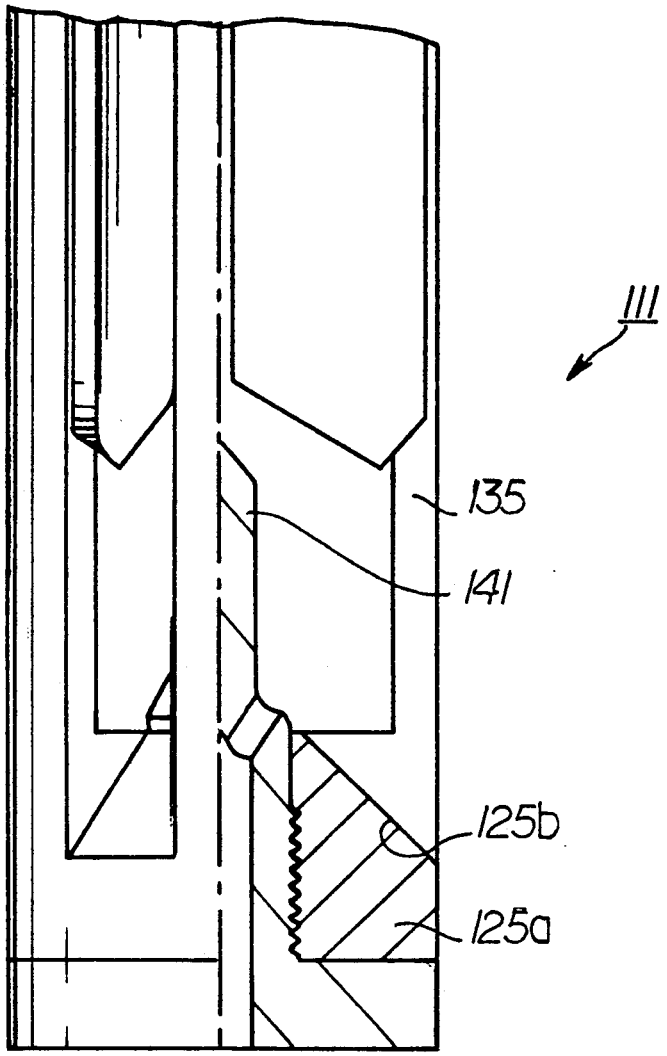

FIGS. 7*a*, 7*b*, and 7*c* should be read together and illustrate, in one-quarter longitudinal section, an alternative preferred embodiment of well service tool 111 according to the present invention. The alternative embodiment of well service tool 111 is a simplified version of well service tool 11 (illustrated in FIGS. 3*a* through 4*c*), which embodies substantially identical operating principles, but is believed to be more easily and less expensively manufactured and assembled.

Well service tool 111 is provided with a mandrel 113, which is threaded at its upper extent for connection into a workstring (not shown). Mandrel 113 is provided with a fluid conduit 113*a* therethrough, which permits fluid communication between mandrel 113 and a fluid pressure source (not shown) in the workstring (not shown). Mandrel 113 is further provided with longitudinal grooves 113*b*, plurality of circumferential grooves 113*c*, and at least one fluid port 113*d*, the respective functions of which are described hereinafter.

A housing collar 115 is slidably disposed about and encloses mandrel 113 A plurality of drive pins 117 are circumferentially spaced about mandrel 113 and cooperate with grooves 113*b* by to secure housing collar 115 against rotation relative to mandrel 113. Drive pins 117 are arranged and function substantially identically to those described with reference to FIGS. 3*a* through 4*c* and FIG. 5.

A housing 119 is coupled by threads to housing collar 115 and likewise surrounds mandrel 113. A housing body 125 is coupled by threads to the housing 119 and likewise surrounds and encloses mandrel 113. Housing body 125 should be considered, along with housing collar 115, and housing 119, to be part of a housing assembly and are provided to ease assembly and manufacture of well service tool 111.

A biasing member 121, in this case a coil spring, is provided intermediate mandrel 113 and housing 119 Biasing member 121 abuts at an upper end thereof mandrel 113 and abuts at a lower end thereof housing 119. Biasing member 121 maintains housing 119 stationary relative to mandrel 113 until a selected fluid pressure is attained within fluid conduit 113*c*.

An expendable knife-mounting member 127 is disposed radially intermediately mandrel 113 and housing body 125. Expendable knife-mounting member 127 is coupled to mandrel 113 by a series of circumferentially spaced collet fingers 127*a* formed at an uppermost end of expendable knife-mounting member 127. Collet fingers 127*a* cooperate with a plurality of mating circumferential grooves 113*c* formed in the exterior of mandrel 113 and the interior of housing body 125 to secure knife-mounting member 127 to mandrel 113.

Knife-mounting member 127 is further provided with a plurality of wash ports 127*b*. Wash ports 127*b* permit pressurized fluid from within well service tool 111 to exit to the exterior of well service tool 111 to provide cooling and lubrication during cutting operations.

A closure member 131, in this case a ball seat, is formed integrally with expendable knife-mounting member 127. Closure member 131 is adapted to receive ball 33 to at least partially obstruct fluid flow through fluid flow conduit 113*a* defined through mandrel 113 Because wash ports 127*b* are provided in expendable knife-mounting member 127, closure member 131 need not be slotted to permit use of well service tool 111 with a mud motor, which requires constant fluid circulation through well service tool 111.

A knife window 135 is provided through the wall of housing body 125 to permit the extension of cutting arm or knife 137. Cutting knife or arm 137 is conventional, and typically is dressed at a cutting end thereof with an abrasive material such as conventional hardfacing or the like. Knife 137 is pivotally secured at another end thereof to expendable knife-mounting member 127 by means of a pin 139. Pins 139 are secured to expendable knife-mounting member 127 substantially as is illustrated in FIG. 6.

A positive extender 125*a* is formed on a lowermost end of housing body 125. Extender 125*a* is formed with an upwardly facing cam surface 125*b*, in this case an inclined surface, adapted to engage a mating, oppositely facing surface on knife 137. Cam surface 125*b* need not be inclined, but could also have a shoulder formed thereon to form a mating shoulder on knife 137 to provide even more positive extension than inclined surface 125*b*.

A probe 141 is coupled by threads to the lowermost end of housing body 125. Probe 141 is of a selected length to engage and open closure member 131 upon a selected extension of cutting knives 137. Relative movement between the housing assembly (including housing collar 115, housing 119, and housing body 125) and mandrel 113 will cause probe 141 to move upwardly relative to closure member 131, and probe 141 will engage and open closure member 131 upon a selected extension of knives 137 by positive extender 125*a*.

Figure 8:
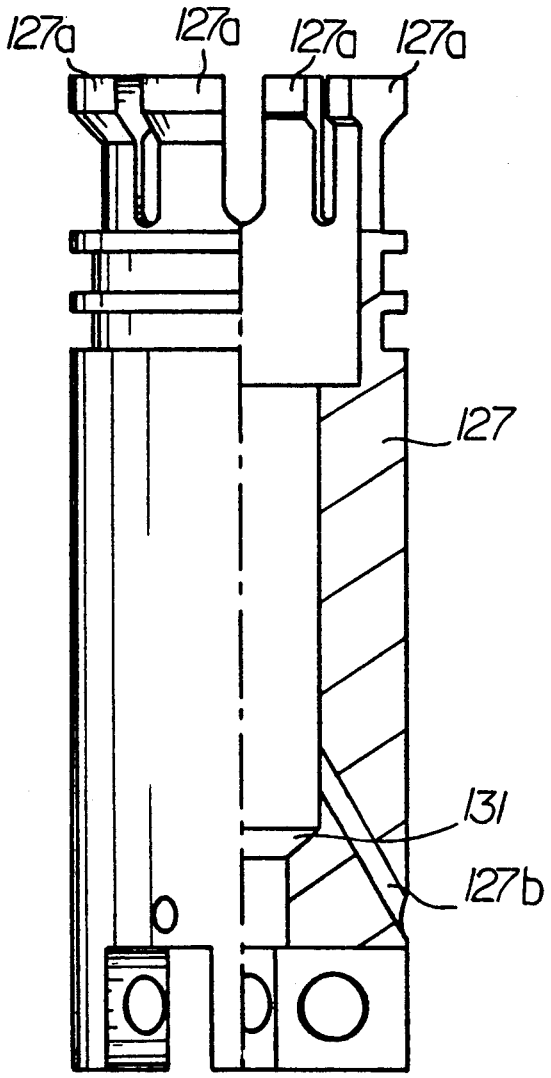
FIG. 8 is a one-quarter longitudinal section view of the knife-mounting member according to the embodiment of present invention illustrated in FIGS. 7*a*, 7*b*, and 7*c*.

FIG. 8 illustrates, in one-quarter longitudinal section, expendable knife-mounting member 127 according to the embodiment of well service tool 111 illustrated in FIGS. 7*a* through 7*c*. Expendable knife-mounting member 127 is illustrated to describe the arrangement of collet fingers 127*a* formed on an uppermost end thereof. Collet fingers 127*a* have shoulders formed thereon for engagement with a plurality of mating circumferential grooves (113*c* in FIG. 7*b*) in mandrel 113 to permit rapid replacement of expendable knife-mounting member 127. The assembly of housing body 125 over expendable knife-mounting member 127 prevents collet fingers 127*a* from inadvertent disengagement with grooves 113*c* in mandrel 113. The collet finger arrangement illustrated in FIG. 8 is less costly to manufacture and assemble than the ball or pin arrangement for securing expendable knife-mounting member 127 to the mandrel 113, as illustrated in FIGS. 3*a* through 4*c*.

With reference to FIGS. 1 through 8, the operation of well service tool 11 (111) according to the present invention will be described. The reference numerals of the embodiment illustrated in FIGS. 1 through 6 will be listed normally, and analogous structures in the embodiment depicted in FIGS. 7*a* through 8 will be listed parenthetically. Well service tool 11 (111) is connected to a workstring (not shown) at the surface. Preferably, the workstring is coiled tubing having a mud motor at a terminal end thereof for connection to well service tool 11 (111). However, the workstring may comprise a drill string, coiled tubing with a fluid pressure source, or other conventional arrangement.

Well service tool 11 (111) then is run into wellbore 3 to a selected depth therein. Typically, well service tool 11 (111) is run through reduced diameter production tubing 5 within an enlarged, cased wellbore 3. The desired depth in wellbore 3 may be the location of undesirable cement, a fish, a natural obstruction within wellbore 3, or a section of damaged casing that is desired to be disintegrated.

For the underreaming operation shown, the desired depth in wellbore 3 is a point at which knives 37 may be extended into engagement with reduced-diameter open wellbore 7. Upon reaching the desired depth in wellbore 9, closure member 31 (131) is closed to obstruct fluid flow through fluid conduit 13*a* (113*a*) in mandrel 13 (113) of well service tool 11 (111). preferably, a ball 33 (133) is provided in fluid conduit 13*a* (113*a*) of well service tool 11 (111) at assembly and cooperates with closure member 31 (131) to obstruct flow through fluid conduit 13*a* (113*a*). With fluid conduit 13*a* (113*a*) obstructed, fluid pressure within mandrel 13 (113) may be increased. A surface pump (not shown) is activated to achieve a selected increase in fluid pressure. Pressurized fluid within fluid conduit 13*a*(113*a*) passes through port 13*d* (113*d*) in mandrel and forces housing 19 (119) and expendable knife-mounting member 27 (127) apart, which causes relative movement between the pressure-responsive member (housing collar 15 (115), housing 19 (119), and housing body 25 (125)), and mandrel 13 (113).

The relative movement between pressure-responsive housing assembly 15, 19, 25,(115, 119, 125) and mandrel 13 (113) causes stabilizers 23 (no analogue) and knives 37 (137) to extend generally radially outwardly from the exterior of well service tool 11 (111), through stabilizer windows 21 (no analogue) and knife windows 35 (135) respectively.

Stabilizers 23 (no analogue) are extended by engagement of pinion gear teeth 23*a* (no analogue) on stabilizer 23 (no analogue) with rack gear teeth 13*c* (no analogue) on mandrel 13 (113) as housing 15, 19, 25 (115, 119, 125) moves relative to mandrel 13 (113). Knives 37 (137) are extended, and are maintained temporarily in the extended position, by positive extenders 25*a* (125*a*), which are part of housing body 25 (125). Upper cam surfaces 25*b*(125*b*) of positive extenders 25*b* (125*b*) engage mating cam surfaces on knives 37 (137) to pivot knives 37 (137) about pins 39 (139), wherein the cutting ends of knives 37 (137) are extended generally radially outwardly from well service tool 11 (111).

Upon a selected extension of knives 37 (137), probe 41 (141), which is secured to housing body 25 (125), engages ball 33 (133), which displaces ball 33 (133) from ball seat or closure member 31 (131). The displacement of ball 33 (133) from ball seat or closure member 31 (131) opens or reduces the obstruction of fluid flow through fluid conduit 13*a* (113*a*) of mandrel 13 (113). The reduced obstruction of fluid flow results in a significant pressure drop within fluid conduit 13*a* (113*a*). This significant pressure drop can be noted on a pressure gage at the surface, thereby giving a positive indication of the selected extension of knives 37 (137).

After the selected extension of knives 37 (137) is obtained, rotation of well service tool 11 (111) is commenced. Preferably, such rotation is obtained through a mud motor connected immediately above well service tool 11 (111) in a coiled tubing workstring. Rotation of well service tool 11 (111) permits knives 37 (137) to engage and disintegrate open wellbore 7, or other objects, whether casing, fish, or the like, desired to be disintegrated.

If wellbore tool 11 (111) is used on coiled tubing, it is advantageous to enlarge wellbore 3 or mill out a section of casing by pulling upwardly or exerting a tensile force on the coiled tubing. Coiled tubing is relatively thin-walled and has a low compressive buckling strength. Therefore, it is advantageous to underream formation material by pulling upwardly on the coiled tubing, because the coiled tubing is maintained in tension.

Because cutting upwardly through an object places an increased load on knives 37 (137) (tending to move them to a retracted position), the positive extension provided by positive extenders 25*a* (125*a*) under knives (37) (137) provides extremely positive mechanical extension of knives 37 (137) as long as increased fluid pressure in fluid conduit 13*a* (113*a*) is maintained. The maintenance of fluid pressure in fluid conduit 13*a* (113*a*) maintains housing assembly 15, 19, 25 (115, 119, 125) displaced relative to mandrel 13 (113), and thereby maintains positive extenders 25*a* (125*a*) in extending interposition under knives 37 (137), preventing premature collapse or retraction of knives 37 (137). Even if fluid pressure is reduced below levels required to extend knives 37 (137), frictional engagement between knives 37 (137) and upper cam surfaces 25*b* (125*b*) of positive extenders 25*a* (125*a*) will maintain knives 37 (137) in the extended position without permitting retraction.

Prevention of premature collapse or retraction of knives 37 (137) allows them to remain in cutting engagement with the object to be disintegrated, and permits milling of a constant-gage or -diameter hole therethrough.

Such positive cutting engagement is particularly desirable if well service tool 11 (111) is run-in on a coiled tubing workstring because coiled tubing lengthens as fluid pressure within it increases Such lengthening can cause knives 37 (137) to lose the kerf formed in the object to be disintegrated if knives 37 (137) are not very positively engaged with the object. Because knives 37 (137) are very positively extended into cutting engagement with the object to be disintegrated, the possibility of losing the kerf and resulting inefficient and ineffective cutting is minimized.

Upwardly cutting through the reduced-diameter open wellbore 7 has a further advantage in that cuttings do not settle on top of well service tool 11 (111), but are washed down enlarged open wellbore 9. Washing cuttings away from well service tool 11 (111) promotes efficient circulation of fluid, which enhances the cutting speed and the life of knives 37 (137).

Still further, as is illustrated in FIG. 2, upwardly underreaming maintains a reduced-diameter section of wellbore 7 above well service tool 11 (111) so that higher fluid circulation velocity is obtained for a given volume flow rate through the workstring and tool 11 (111). This increased fluid velocity further enhances cooling and washing of tool 11 (111) and wellbore 3, 7, 9. If underreaming is performed in a downward direction, an enlarged portion of open wellbore (9 in FIG. 2) is above well service tool 11 (111) causing a reduction in fluid velocity and inefficient cooling and washing Additionally, pulling well service tool (111) upwardly while underreaming inherently centralizes tool 11 (111) in wellbore 3, 7, 9, providing more consistent and efficient cutting of full gage holes (9 in FIG. 2). Also, pulling upwardly or exerting tensile force on well service tool 11 (111) obviates the need for workstring weight on tool 11 (111). In deviated wellbores it is often very difficult to transmit weight to a tool for cutting engagement with an object. Cutting in an "upward" direction relies purely on tensile force (supplied from the surface) on the workstring, rather than the ability to transmit compressive forces or weight from the workstring to tool 11 (111). "Upward" cutting is advantageous both for coiled tubing operations and operations in deviated wellbores.

After well service tool 11 (111) is rotated and the desired disintegration of the object in wellbore 3 is accomplished, well service tool 11 (111) is tripped-out of wellbore 3. If well service tool 11 (111) has been run in through reduced-diameter production tubing or the like, it is desirable that stabilizers 23 (no analogue) and knives 37 (137) return to a retracted position within well service tool 11 (111). As well service tool 11 (111) is pulled back through reduced-diameter production tubing (5 in FIGS. 1 and 2), the end of the production tubing (5 in FIGS. 1 and 2) will engage stabilizers 23 (no analogue), causing them to retract within housing 19 (119) of well service tool 11 (111). As stabilizers 23 (no analogue) are retracted, the engagement between pinion gear teeth 23*a* (no analogue) and rack gear teeth 13*c* (no analogue) will induce reversed relative movement between housing 19 (119) and mandrel 13 (113). Such reversed relative movement Will move positive extender 25*a* (125*a*) away from knives 37 (137), causing knives 37 (137) to retract within housing body 25 (125).

Even if well service tool 11 (111) is not provided with stabilizers 23 (as in the embodiment of FIGS. 7*a*through 8), or stabilizers 23 fail, engagement between extended knives 37 (137) and the end of the production tubing will likewise cause knives 37 (137) to retract from the extended position to housing body 25 (125). In the embodiment illustrated in FIGS. 7*a* and 7*c*, biasing member 121 will further assist in achieving reversed relative movement between the housing assembly (115, 119, 125) and mandrel 113 after fluid pressure in fluid conduit 13 (113*c*) is reduced, thereby permitting retraction of knives 137.

With stabilizers 23 (no analogue) and knives 37 (137) retracted within well service tool 11 (11 1), well service tool 11 (111) may be tripped-out of wellbore 9.

If, during cutting operation, knives 37 (137), or expendable knife-mounting member 27 (127), fail or are damaged, repair or replacement of knives 37 (137) or expendable knife-mounting member 27 (127) may be effected quickly and easily in a field location proximal to the wellbore site. Such a repair or replacement is effected by disassembly of housing body 25 (125) from housing 19 (119), thereby exposing knife-mounting member 27 (127) and freeing pins 39 (139) and knives 37 (137) for uncoupling and repair or replacement. Such repair or replacement could include replacing knives 37 (137) only, recoupling an undamaged knife-mounting member 27 (127) to mandrel 13 (113), or any combination thereof. After repair or replacement of knives 37 (137) or knife-mounting member 37 (137), well service tool 11 (111) may be run into wellbore 3 again, and cutting operations continued.

Thus, well service tool 11 (111) according to the present invention is operable in a plurality of modes of operation. One mode of operation is a run-in, unset, or retracted mode of operation in which stabilizers 23 (no analogue) and knives 37 (137) are retracted within well service tool 11 (111). Another mode of operation is the set, extended, or cutting mode of operation, in which stabilizers 23 (no analogue) and knives 37 (137) are extended from the exterior of well service tool 11 (111) for cutting engagement with an object in wellbore 9.

The well service tool according to the present invention has a number of advantages. One advantage is that the cutting knives of the tool are mounted to an expendable, easily and inexpensively replaced or repaired, component of the tool. This advantage results in a well service tool that is more easily and inexpensively repaired, and therefore less expensive to operate.

Another advantage of the present invention is that the cutting knives are positively extended by a solid, mechanical extender. Such an extender more positively extends the cutting knives, and more positively maintains the knives in the extended position, than hydraulic pistons. Such positive extension and maintenance thereof permits the well service tool according to the present invention to consistently bore or mill constant-diameter or constant-gage holes through the object to be disintegrated.

Yet another advantage of the present invention is that the stabilizers provide a means, other than the knives themselves, to retract the cutting knives into a retracted position within the well service tool, thereby facilitating tripping-out of the well service tool.

Still another advantage of the present invention is that the positive extension of the cutting knives permits the well service tool to be pulled upward during drilling or boring operations, facilitating the use of the tool in coiled tubing operations, and enhancing beneficial fluid circulation.

Still a further advantage of the present invention is that the use of an expendable knife-mounting member within the exterior housing of the well service tool permits use of larger-diameter knife-mounting pins, thereby increasing the strength of the well service tool.

The invention has been described with reference to a preferred embodiment thereof. Those skilled in the art will appreciate that the invention, not thus limited, but is susceptible to variations and modifications without departing from the scope and spirit thereof.

We claim:

1. A well service tool for use in a wellbore, the well service tool comprising:

a mandrel having a fluid conduit therethrough, the mandrel couplable in fluid flow communication with a fluid pressure source;

an expendable knife-mounting member coupled to the mandrel;

at least one knife pivotally secured to the expendable knife-mounting member; and a pressure-responsive member including a positive extender to selectively extend the knife, and to selectively temporarily maintain the knife in an extended position, responsive to a relative movement between the pressure-responsive member and the mandrel, the relative movement induced by increased fluid pressure from the fluid pressure source, wherein an end of the knife is extended generally radially outwardly from an exterior of the well service tool.

2. The well service tool according to claim 1 further comprising:

a closure member disposed in the fluid conduit to selectively obstruct fluid flow through the fluid conduit, wherein fluid pressure within the fluid conduit is selectively increased; and a probe secured to the pressure-responsive member to engage and open the closure member upon a selected extension of the knife from the well service tool, wherein fluid pressure within the fluid conduit is decreased.

3. The well service tool according to claim 1 further comprising at least one stabilizer coupled to the pressure-responsive member and extendable therefrom responsive to relative movement between the pressure-responsive member and the mandrel to center the well service tool in the wellbore and to provide reversed relative movement between the pressure-responsive member and the mandrel upon tripping out of the well service tool.

4. A well service tool for use in a wellbore, the well service tool comprising:

a mandrel including a fluid conduit in fluid flow communication with a workstring, the workstring including a fluid pressure source;

an expendable knife-mounting member coupled to the mandrel;

at least one knife secured to the expendable knife-mounting member;

a pressure-responsive member disposed about and secured against rotation relative to the mandrel, the pressure-responsive housing including a positive extender to selectively extend the knife, and to temporarily selectively maintain the knife in an extended position, responsive to relative movement between the housing and the mandrel, wherein an end of the knife is extended generally radially outwardly from an exterior of the well service tool;

a closure member disposed in the fluid conduit to selectively obstruct fluid flow through the fluid conduit, wherein fluid pressure within the fluid conduit is increased and relative movement between the pressure-responsive housing and the mandrel is induced; and a probe secured to the pressure-responsive member to open the closure member upon a selected extension of the end of the knife, wherein fluid pressure within the fluid conduit is decreased.

5. The well service tool according to claim 4 further comprising at least one stabilizer coupled to the pressure-responsive member and extendable therefrom responsive to relative movement between the pressure-responsive member and the mandrel to center the well service tool in the wellbore, and to provide reversed relative movement between the pressure-responsive member and the mandrel upon tripping-out the well service tool.

6. A well service tool for use in a wellbore, the well service tool comprising:

a mandrel including a fluid flow conduit therethrough, the mandrel couplable in fluid flow communication with a workstring, the workstring including a fluid pressure source;

an expendable knife-mounting member coupled to the mandrel, the expendable knife-mounting member including at least one knife pivotally secured to the expendable knife-mounting member by a pin;

a housing coupled to and secured against rotation relative to the mandrel by at least one drive pin, the housing selectively movable relative to the mandrel responsive to fluid pressure, the housing including a positive extender to selectively engage and rotate, and to temporarily selectively maintain in an extended position, the knife about the pin, wherein an end of the knife extends generally radially outwardly from the housing;

a closure member coupled to the expendable knife-mounting sleeve to selectively obstruct fluid flow through the mandrel wherein fluid pressure in the mandrel is increased and relative movement between the housing and the mandrel is induced;

a probe secured to the housing to open the closure member upon a selected extension of the knife, wherein fluid pressure within the mandrel is decreased; and at least one stabilizer coupled between the mandrel and the housing, the stabilizer extendable generally radially outwardly into engagement with the wellbore while the knife is in the extended position, the stabilizer to center the well service tool in the wellbore and to urge reversed relative movement between the housing and the mandrel to permit retraction of the knife from extension from the housing.

7. The well service tool according to claim 6, wherein the stabilizer is coupled to the housing by a pin and wherein an end of the stabilizer adjacent the pin is provided with pinion gear teeth for selective engagement with mating rack gear teeth provided on the mandrel.

8. The well service tool according to claim 6, wherein the positive extender is provided with a cam surface and the knife is provided with an opposing and mating surface for engagement with the cam surface of the knife.

9. The well service tool according to claim 6, wherein the closure member is a ball seat for receiving a ball.

10. The well service tool according to claim 6, wherein the probe is an elongate member of a length selected to engage the closure member upon a selected relative movement of the housing relative to the mandrel.

11. A well service tool for disintegrating an object in the wellbore, the well service tool comprising:

a mandrel in fluid communication with a fluid pressure source;

a housing disposed about the mandrel and movable relative to the mandrel in response to fluid pressure;

at least one cutting knife pivotally coupled to at least a portion of the mandrel by at least one drive pin;

wherein the drive pin is retained in a pivotally securing position by coupling at least a portion of the housing about the mandrel.

12. The well service tool 11 according to claim 11 further including an expendable knife-mounting member coupled to the mandrel for receiving the at least one drive pin to pivotally couple the at least one knife to the expendable knife-mounting member.

13. A method of disintegrating an object in a wellbore, the method comprising the steps of:

providing a well service tool including:

a mandrel in fluid flow communication with the fluid pressure source;

an expendable knife-mounting member coupled to the mandrel;

at least one knife pivotally secured to the expendable knife-mounting member;

assembling the well service tool onto a workstring including a fluid pressure source;

running the well service tool to a selected location in the wellbore;

extending the at least one knife into an extended position;

disintegrating at least a portion of an object in the wellbore by rotating the well service tool; and tripping the well service tool out of the wellbore.

14. The method according to claim 13 further comprising the steps of:

uncoupling the expendable knife-mounting member from the mandrel; and replacing at least the expendable knife-mounting member by recoupling an undamaged knife-mounting member to the mandrel at a field location proximal to the wellbore.

15. The method according to claim 13 further comprising the step of:

uncoupling the expendable knife-mounting member from the mandrel; and replacing at least the at least one knife with an undamaged knife at a field location proximal to the wellbore.

16. The method according to claim 13 wherein the step of disintegrating at least a portion of an object in the wellbore further includes pulling the well service tool upwardly through the wellbore by exerting tensile force on the workstring during the rotation of the well service tool.

17. A method of disintegrating an object in a wellbore, the method comprising the steps of:

providing a well service tool including at least one knife secured to the well service tool and extendable therefrom into cutting engagement with the object;

assembling the well service tool into a workstring;

running the well service tool to a selected location in the wellbore;

extending the at least one knife into an extended position;

disintegrating at least a portion of the object by rotating the well service tool and exerting a tensile force on the workstring wherein the well service tool is pulled upwardely through the object; and tripping the well service tool out of the wellbore.

18. The method according to claim 17 wherein the workstring is incapable of bearing substantial compressive forces.

19. The method according to claim 17 wherein the workstring further comprises coiled tubing with a fluid-powered motor coupled thereto for rotating the well service tool.

* * * * *